US005528228A

United States Patent [19]

Wilk

[11] Patent Number: 5,528,228

[45] Date of Patent: Jun. 18, 1996

[54] PROTECTIVE DEVICE FOR STORAGE AND TRANSPORT CONTAINERS

[76] Inventor: Peter J. Wilk, 185 W. End Ave., New York, N.Y. 10023

[21] Appl. No.: 303,082

[22] Filed: Sep. 8, 1994

[51] Int. Cl.[6] ..... G08B 21/00

[52] U.S. Cl. ..... 340/686; 340/584; 340/429; 379/52; 200/61.45 R

[58] Field of Search ..... 340/686, 541, 340/584, 571, 693, 689, 521, 572, 429, 529, 441; 379/58; 200/61.45 R; 364/425.06

[56] References Cited

U.S. PATENT DOCUMENTS

| | | | |
|---|---|---|---|
| 3,909,568 | 9/1975 | Greenhug | 200/61.45 R |
| 3,961,323 | 6/1976 | Hartkorn | 340/572 |
| 4,462,023 | 7/1984 | Nielsen et al. | 340/571 |
| 4,685,061 | 8/1987 | Whitaker | 340/441 |
| 4,688,244 | 8/1987 | Hannon et al. | 379/58 |
| 4,750,197 | 6/1988 | Denekamp et al. | 379/58 |
| 4,841,285 | 6/1989 | Laut | 340/571 |
| 5,027,105 | 6/1991 | Dailey et al. | 340/571 |
| 5,051,725 | 9/1991 | Caccitolo | 340/571 |
| 5,153,561 | 10/1992 | Johnson | 340/571 |
| 5,347,274 | 9/1994 | Hassett | 340/988 |

*Primary Examiner*—Brent A. Swarthout

*Assistant Examiner*—Benjamin C. Lee

*Attorney, Agent, or Firm*—R. Neil Sudol; Henry D. Coleman

[57] ABSTRACT

A protective device for storage and transport containers comprises a sensor for detecting orientation, an attachment element for securing the sensor to a container, and an alarm operatively coupled to the sensor for generating a cognizable alert signal upon detection by the sensor that the container is in an orientation other than a predetermined preferred orientation. The alarm may include an electroacoustic transducer and means for reproducing a voice message. A timer operatively connected to the sensor measures a time interval during which the container is in an orientation other than the preferred orientation. A memory is operatively connected to the timer for automatically storing the time interval in encoded form. A mechanism and/or circuit may be operatively connected to the timer and the memory for deactivating the timer and for locking the memory to ensure integrity of contents of the memory upon an opening of the container. The device may also include a detector for measuring temperature. The alarm is operatively connected to the detector for generating a cognizable indicator signal upon measurement of a temperature beyond a pre-established threshold. The timer is operatively connected to the temperature detector for measuring a time period during which the container is in a temperature range beyond the threshold, while the memory is operatively connected to the timer for automatically storing the time period in encoded form.

17 Claims, 2 Drawing Sheets

PROTECTIVE DEVICE FOR STORAGE AND TRANSPORT CONTAINERS

BACKGROUND OF THE INVENTION

This invention relates mainly to a protective device for storage and transport containers. This invention also relates to an associated method for use in protecting contents of storage and transport containers.

A long standing problem in the shipping industry is damage to shipped goods. Containers holding fragile items are universally labeled with warnings such as "fragile" and "this side up." Despite such precautions, packages are nevertheless frequently subjected to treatment which damages their contents.

Besides impacts and misorientation, packages are sometimes subjected to other inordinately extreme conditions such as very low temperatures and severe jostling or shaking.

OBJECTS OF THE INVENTION

An object of the present invention is to provide a device attachable to a shipping container for aid in alleviating at least one of the above-mentioned conditions.

Another, more particular, object of the present invention is to provide such a device which assists in reducing the incidence of misorientation of packages during shipment and storage.

A further object of the present invention is to provide a device which can be used, for instance, by the insurance industry to at least partially determine treatment of a package during shipment.

Yet another object of the present invention is to provide an associated method for reducing the incidence of misorientation of packages during shipment and storage.

These and other objects of the present invention will be apparent from the drawings and detailed descriptions herein.

SUMMARY OF THE INVENTION

A protective device for storage and transport containers comprises, in accordance with the present invention, a sensor for detecting orientation, an attachment element for securing the sensor to a container, and an alarm operatively coupled to the sensor for generating a cognizable alert signal upon detection by the sensor that the container is in an orientation other than a predetermined preferred orientation.

The alarm may include an electroacoustic transducer and means for reproducing a voice message. Such means may comprise, for example, (i) a memory component such as a recording tape or a solid state circuit and (ii) a speech reproduction unit such as an audio playback unit or digital-to-analog speech synthesis componentry.

A device in accordance with the present invention provides an additional stimulus or reminder to shipping personnel to right a misoriented package. Generally, it is contemplated that the alarm continues to sound until the container is placed in its preferred orientation.

According to another feature of the present invention, the device further comprises a timer operatively connected to the sensor for measuring a time interval during which the container is in an orientation other than the preferred orientation. A memory is operatively connected to the timer for automatically storing the time interval in encoded form.

This feature of the invention provides a check on the care taken by the shipper. The device can be returned to the manufacturer for determining the shipment history with regard to the orientation of the container and its contents. This shipment history information is valuable to insurers (including the manufacturer under warranty) for allocating responsibility and liability.

According to a further feature of the present invention, the device also comprises a mechanism and/or circuit operatively connected to the timer and the memory for deactivating the timer and for locking the memory to ensure integrity of contents of the memory upon an opening of the container. This deactivation componentry may include a switch or circuit tied to the lid of the container, e.g., via a string, wire or thread.

This feature of the invention serves to prevent a shipper from removing the device from a shipping container and reprogramming the memory before the device is returned to the manufacturer. Generally, it is contemplated that the buyer or other receiver of the shipped goods removes the protective device and returns it to the manufacturer. Of course, the sensor may also be deactivated so that it is inoperative during the return trip to the manufacturer. The memory also contains a recording of the time that the container was opened. If opening occurs prior to receipt by the customer, then a legal cause of action against the shipper may be entertained.

According to an additional feature of the present invention, the device further comprises a detector for measuring temperature. The alarm is operatively connected to the detector for generating a cognizable indicator signal upon measurement of a temperature beyond a pre-established threshold. For example, if perishable food or temperature sensitive equipment is being shipped in the container, an alarm sounds when the temperature of the container rises beyond a predetermined maximum. If living organisms are being shipped, then an alarm will sound if the temperature of the container falls below a pre-established minimum.

According to a related feature of the invention, the timer is operatively connected to the detector for measuring a time period during which the container is in a temperature range beyond the threshold, while the memory is operatively connected to the timer for automatically storing the time period in encoded form. Thus, a record of the temperature during shipment and storage is automatically generated, at least for insurance and quality control purposes.

In some cases, it may be desirable to have the recording capability without the alarm. Accordingly, a device for obtaining information pertaining to shipment histories comprises, in accordance with the present invention, a sensor for detecting orientation, an attachment element for securing the sensor to a container, a timer operatively connected to the sensor for measuring a time interval during which the container is in an orientation other than the preferred orientation, and a memory operatively connected to the timer for automatically storing the time interval in encoded form.

As discussed hereinabove, a de-activation component may be operatively connected to the timer and the memory for turning the timer off and for locking the memory to ensure integrity of contents of the memory after the container has been opened. As also discussed above, the device may further comprise a detector for measuring temperature, the timer being operatively connected to the detector for measuring a time period during which the container is in a temperature range beyond the threshold and the memory being operatively connected to the timer for automatically storing the time period in encoded form.

A method for use in protecting contents of storage and transport containers comprises the steps of (a) automatically and at least periodically detecting orientation of a storage and transport container holding fragile contents, and (b) automatically generating a cognizable alert signal upon detecting that the container is in an orientation other than a predetermined preferred orientation.

In accordance with another feature of the present invention, the cognizable alert signal is generated by producing a sound wave via an electroacoustic transducer. The step of producing a sound wave may include the step of producing a voice message such as "Please straighten me out" or "Attention, attention, turn this box upright."

In accordance with a further feature of the present invention, the method also comprises the steps of (i) automatically measuring a time interval during which the container is in an orientation other than the preferred orientation and (ii) automatically storing (recording) the time interval in encoded form. Additional steps may include (iii) deactivating the timer and (iv) locking the memory to ensure integrity of contents of the memory upon an opening of the container.

In accordance with yet another feature of the present invention, the method further comprises the steps of automatically measuring temperature in the container and generating a cognizable indicator signal upon measurement of a temperature beyond a pre-established threshold. The time during which the container is in a temperature range beyond the threshold may be monitored and automatically recorded.

Other conditions of a container during shipment may be monitored and recorded. For example, the size and frequency of impacts may be monitored by a strain gauge network embedded in a flexible or resilient matrix and connected to an inertial mass also embedded in the matrix. The strain gauges are operatively connected to a monitoring circuit including a timer and a memory.

DETAILED DESCRIPTION

Figure 1:
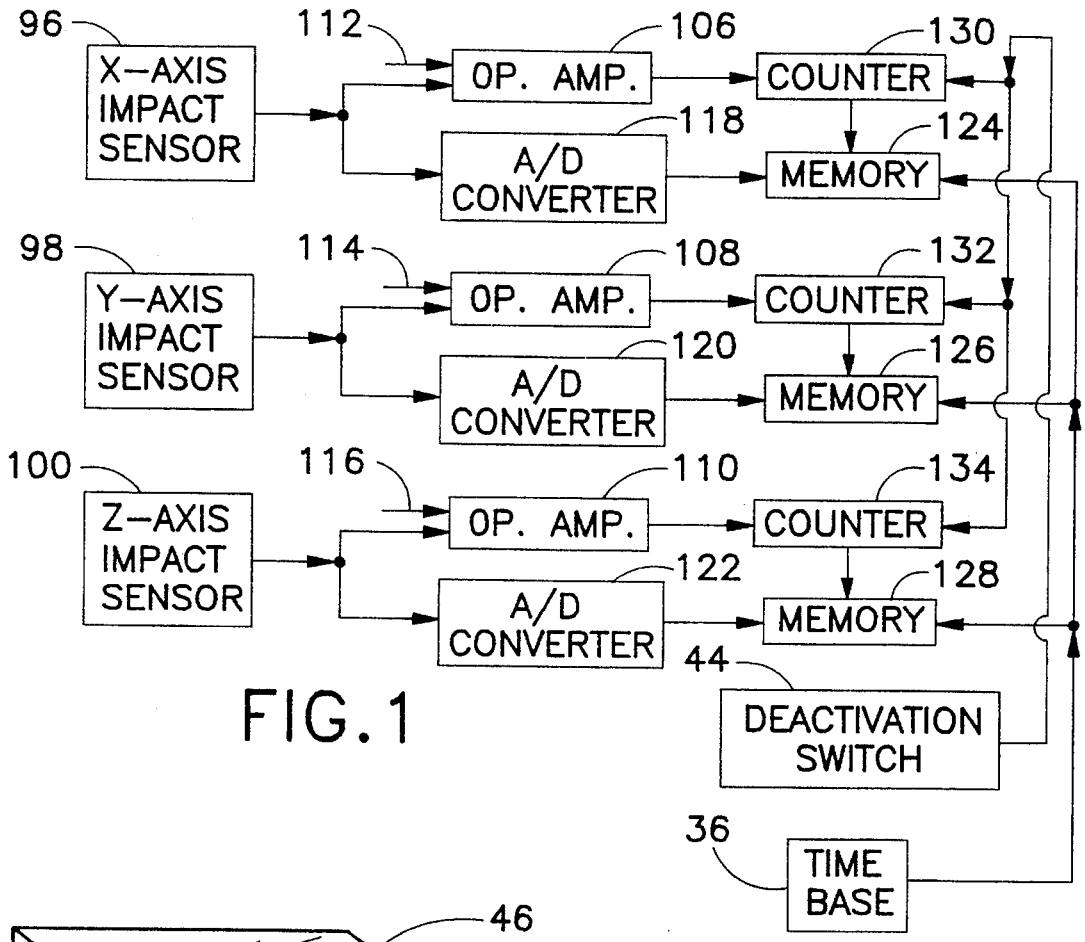
FIG. 1 is a schematic perspective view, on a reduced scale, of a protective device for storage and transport containers, showing disposition of the device in a shipping container, in accordance with the present invention.

As shown in FIG. 1, a protective device 10 for monitoring shipping conditions undergone by a storage and transport container 12 includes a housing or casing 14 attached via an adhesive layer 16, bolts (not shown) or other fastening elements to a side panel 18 of container 12.

Figure 2:
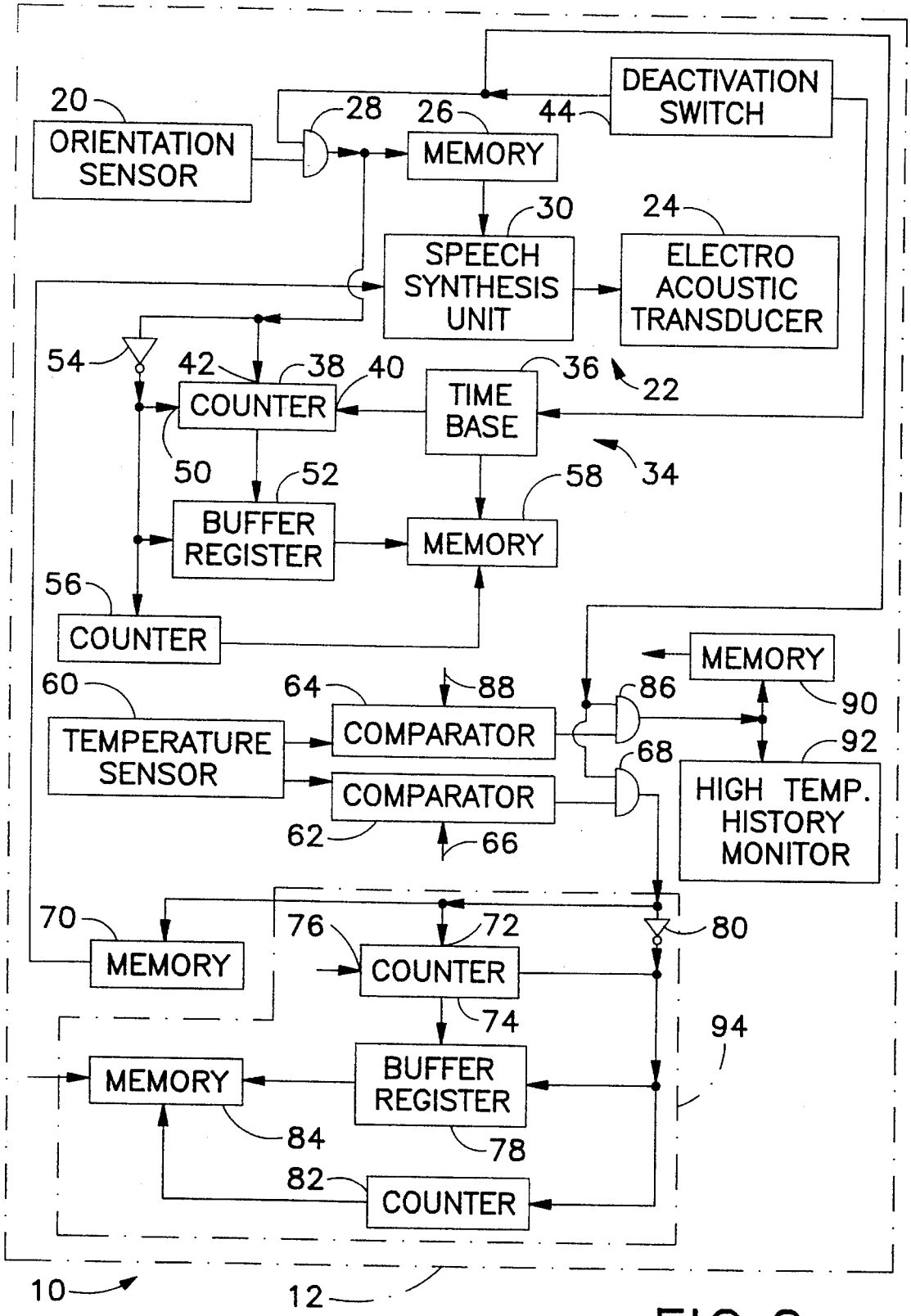
FIG. 2 is a block diagram of functional components of the protective device of FIG. 1.

As illustrated in FIG. 2, protective device 10 comprises a sensor 20 for detecting orientation and alarm componentry 22 operatively coupled to the sensor for generating a cognizable alert signal upon detection by the sensor that the container is in an orientation other than a predetermined preferred orientation. Sensor 20 may incorporate a gravity switch (not separately shown) for detecting when container 12 is not in an upright orientation.

Alarm componentry 22 includes an electroacoustic transducer 24 and a solid state memory 26. Memory 26 stores at least one digitally encoded voice message such as "Box not in correct orientation," "Please place container in upright position," "I am on my side; please stand me up." Upon receiving an activation signal from sensor 20 via an AND gate 28, memory 26 transmits the digitally encoded warning or command to a speech synthesis unit 30. Speech sythesis unit 30 converts the digitally encoded voice message from memory 26 into an analog signal which is fed to an electroacoustic transducer 24 for acoustic reproduction.

Memory 26 and speech synthesis unit 30 may be replaced with an equivalent combination of elements such as a recording tape (not shown) and an audio playback unit (not shown).

The alarm componentry 22 of protective device 10 provides a stimulus or reminder to shipping personnel to right a misoriented package. Generally, it is contemplated that the alarm continues to sound until the container is placed in its preferred orientation.

As further illustrated in FIG. 2, device 10 also comprises a timer 34 including a time base 36 and a counter 38. Time base 36 generates a clock signal which is fed to an incrementing input 40 of counter 38 for measuring a time interval during which container 12 is in an orientation other than the upright orientation. The contents of counter 38 are incremented by the clock signal from time base 36 as long as an enabling input 42 of counter 38 is provided with a high logic signal. Counter input 42 is operatively connected to orientation sensor 20 via AND gate 28. Thus, counter 38 continues to measure time as long as orientation sensor 20 detects a misorientation of container 12 and as long as a deactivation switch 44 is transmitting a high logic signal to AND gate 28. Switch 44 changes its output to a low logic signal only upon the opening of container 12. To that end, switch 44 is connected to a lid 46 of container 12 via a wire 48 (FIG. 1).

Orientation sensor 20 is connected to a resetting input 50 of counter 38 and to an enabling input of a buffer register 52 via an inverter 54. Upon the righting of container 12 and a consequent reversion of the output of orientation sensor 20 to a low logic level from a high logic level, a high level logic signal from inverter 54 causes the contents of counter 38 to be transferred to buffer register 52 and induces the resetting of counter 38.

Inverter 54 is also connected to an incrementing input of a counter 56 which acts as an addressing and writing control for a solid state random access memory 58. Upon the incrementing of the contents of counter 56, the encoded time interval stored in buffer register 52 is transferred to an address location in memory 58 specified by the updated contents of counter 56. The time at which the loading of the encoded time interval into memory 58 occurs may also be stored in memory 58. This time is loaded from time base 36.

Thus, memory 58 contains an account or record of the intervals of misorientation of container 12. This record is terminated upon the opening of lid 46 and the consequent transmission of a low logic level disabling signal from switch 44 to AND gate 28. This diabling or deactivation signal effectively serves to lock memory 58.

Switch 44 may also be connected to time base 36 and at least indirectly to memory 58 for storing the time at which the container is opened. This time should correspond to the arrival of the container at the customer's location.

The contents of memory 58 enable a manufacturer to check on the care taken by a shipper or carrier. Device 10 can be returned to the manufacturer for determining the shipment history with regard to the orientation of the container and its contents. This shipment history information may be used by insurers for allocating responsibility and liability.

As additionally illustrated in FIG. 2, device 10 further comprises a detector or sensor 60 for measuring temperature. Alarm componentry 22 is operatively connected to temperature sensor 60 for generating a cognizable indicator signal upon measurement of a temperature beyond a pre-established threshold. To implement that function, sensor 60 is connected at an output to a pair of comparators 62 and 64 which may be analog elements such as operational amplifiers. Upon a falling of the temperature of container 12 below a predetermined minimum threshold (encoded in an input signal 66 to comparator 62), comparator 62 generates a signal of a high logic level which is fed to an AND gate 68. Provided that switch 44 is not generating a disabling signal, AND gate 68 passes the high logic level signal from comparator 62 on to a solid state memory 70. Memory 70 is enabled by that high logic level signal to transmit a digitally encoded voice message to speech sythesis unit 30. The message may be, for example, the words "I am too cold; please turn up the heat," or "Temperature below minimum limit; please reset temperature."

AND gate 68 is also connected to an enabling input 72 of a counter 74 which has an incrementing input 76 connected to time base 36 for receiving the clock signal output thereof. Counter 74 has an output connected to a buffer register 78 for loading a measured time interval into the buffer register upon the detection by sensor 60 of a decrease in temperature beyond the pre-established minimum. Sensor 60 is connected to an enabling or writing input of buffer register 78 via an inverter 80, as well as via comparator 62 and AND gate 68. Upon the appearance of a high logic level signal at the output of inverter 80, the contents of counter 74 are transferred to register 78 and the counter is reset. In addition, inverter 80 is coupled to an address counter 82 which controls the location in a memory 84 at which the time interval from register 78 is stored. Memory 84 may also be connected to time base 36 for recording the time at which the interval of reduced temperature occurred.

As also illustrated in FIG. 2, comparator 64 is connected to an AND gate 86 which also receives an enabling signal from switch 44. Upon detecting a rise in temperature of container 12 beyond a maximum encoded in a signal 88, comparator 64 issues a high logic level signal to AND gate 86. Provided that switch 44 is not generating a disabling signal due to the opening of lid 46 (FIG. 1), a high level logic signal is transmitted from AND gate 86 to a voice message memory 90 for inducing that circuit element to transmit a digitally encoded voice message to speech synthesis unit 30. The message may be, for example, the words "I am too hot; please turn down the heat," or "Temperature above maximum limit; please reset temperature."

The high logic level signal from AND gate 86 may also be transmitted to a high temperature history monitoring circuit 92 including elements structurally identical to the elements of a low temperature history monitoring circuit 94. Those elements include counter 74, register 78, inverter 80, counter 82, and memory 84. Monitoring circuit 94 thus memorizes the durations of the time intervals during which container 12 experienced excessively low temperatures.

Figure 3:
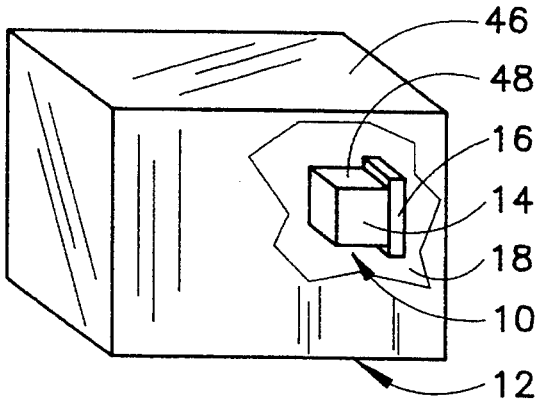
FIG. 3 is a block diagram of additional components optionally utilizable in the device of FIGS. 1 and 2.
Figure 4:
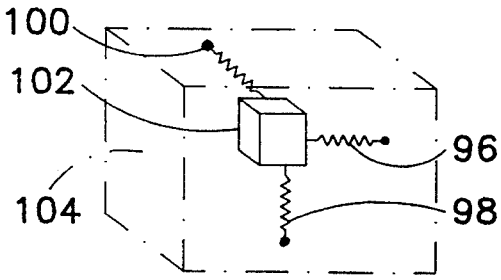
FIG. 4 is a schematic perspective view of a composite impact sensor utilizable in a device in accordance with the present invention.

As depicted in FIG. 3, device 10 may additionally comprise a plurality of impact sensors 96, 98 and 100 for detecting the sizes of impacts experienced by container 12 during shipment. As indicated in FIG. 4, sensors 96, 98 and 100 may take the form of respective strain gauges operatively connected to an inertial mass 102 and disposed together with the mass in a flexible or resilient medium 104 such as rubber.

As further depicted in FIG. 3, sensors 96, 98, and 100 are operatively connected to respective operational amplifiers or analog comparators 106, 108, and 110 which compare the outputs of the sensors with preset limits represented by signal inputs 112, 114, and 116. Sensors 96, 98, and 100 are also connected at their outputs to respective analog-to-digital converters 118, 120, and 122 which in turn are connected at their outputs to respective memories 124, 126, and 128. The digital output signals of converters 118, 120, and 122 are stored in memories 124, 126, and 128 at addresses determined by the contents of respective address counters 130, 132, and 134. The contents of counters 130, 132, and 134 are incremented upon the appearance of a high level logic signal at the outputs of operational amplifiers 106, 108, and 110.

Counters 130, 132, and 134 also control the writing process in memories 124, 126, and 128. Counters 130, 132, and 134 are disabled by a low-level logic signal from switch 44 upon the opening of container 12. This disabling prevents the writing of further impact information into memories 124, 126, and 128 and effectively locks the memories from erasure or further writing.

Time base 36 may be operatively connected to memories 124, 126, and 128 so that the times of the different impacts may be recorded.

Although the invention has been described in terms of particular embodiments and applications, one of ordinary skill in the art, in light of this teaching, can generate additional embodiments and modifications without departing from the spirit of or exceeding the scope of the claimed invention. It is to be noted, for instance, that the recording of time intervals of unsafe storage or shipping conditions may be implemented merely by storing the times that the intervals begin and the times at which they end. The durations may be computed subsequently from the time data.

Accordingly, it is to be understood that the drawings and descriptions herein are profferred by way of example to facilitate comprehension of the invention and should not be construed to limit the scope thereof.

What is claimed is:

1. A device for obtaining information pertaining to shipment histories for post-shipment determination of treatment of a container package during shipment, comprising:

sensing means for detecting a temperature, impact or mis-orientation physical condition of a container;

attachment means for securing said sensing means to the container;

timing means operatively connected to said sensing means for measuring a time interval during which the container has a predetermined type of said physical condition; and memory means operatively connected to said timing means for automatically storing said time interval in encoded form.

2. The device defined in claim 1 wherein said physical condition is orientation, further comprising alarm means operatively coupled to said sensing means for generating a cognizable alert signal upon detection by said sensing means that the container is in an orientation other than a predetermined preferred orientation.

3. The device defined in claim 2 wherein said alarm means further includes means for reproducing a voice message.

4. The device defined in claim 1 wherein said physical condition is temperature, further comprising alarm means operatively connected to said sensing means for generating a cognizable indicator signal upon measurement of a temperature beyond a pre-established threshold.

5. The device defined in claim 4 wherein said alarm means further includes means for reproducing a voice message.

6. The device defined in claim 1 wherein said physical condition is orientation, said timing means measuring a time interval during which the container is in an orientation other than a preferred orientation.

7. The device defined in claim 1 wherein said physical condition is temperature, said timing means measuring a time period during which the container is in a temperature range beyond a predetermined threshold.

8. The device defined in claim 1, further comprising additional sensing means for measuring impacts on the container, said memory means being operatively connected to said additional sensing means and said timing means for recording times at which the container experiences impacts.

9. The device defined in claim 1, further comprising detection means for detecting an opening of the container, also comprising deactivation means operatively connected to said timing means and said memory means and said detection means for deactivating said timing means and for locking said memory means to ensure integrity of contents of said memory means upon detection by said detection means of an opening of the container.

10. A method for obtaining information pertaining to shipment histories for post-shipment determination of treatment of a container package during shipment, comprising the steps of:

automatically detecting a temperature, impact or misorientation physical condition of a container;

automatically measuring a time interval during which the container has a predetermined type of said physical condition; and automatically storing said time interval in encoded form.

11. The method defined in claim 10 wherein said physical condition is orientation, further comprising the step of generating a cognizable alert signal upon a detection that the container is in an orientation other than a predetermined preferred orientation.

12. The method defined in claim 11 wherein said step of generating includes the step of reproducing a voice message.

13. The method defined in claim 10 wherein said physical condition is temperature, further comprising the step of generating a cognizable indicator signal upon a detection of a temperature beyond a pre-established threshold.

14. The method defined in claim 13 wherein said step of generating includes the step of reproducing a voice message.

15. The method defined in claim 10 wherein said physical condition is orientation, said step of measuring including the step of measuring a time interval during which the container is in an orientation other than a preferred orientation.

16. The method defined in claim 10 wherein said physical condition is temperature, said step of measuring including the step of measuring a time period during which the container is in a temperature range beyond a predetermined threshold.

17. The method defined in claim 10, further comprising the steps of automatically measuring impacts on the container and automatically recording times at which the container experiences impacts.

* * * * *